US008624746B2

(12) United States Patent
Solheim

(10) Patent No.: US 8,624,746 B2
(45) Date of Patent: Jan. 7, 2014

(54) WAIT STAFF SIGNALING APPARATUS WITH HIGH VISIBILITY INDICATORS

(76) Inventor: Brenda Solheim, Santa Rosa, CA (US)

( * ) Notice: Subject to any disclaimer, the term of this patent is extended or adjusted under 35 U.S.C. 154(b) by 319 days.

(21) Appl. No.: 12/992,826

(22) PCT Filed: May 18, 2009

(86) PCT No.: PCT/US2009/044354

§ 371 (c)(1),
(2), (4) Date: Nov. 15, 2010

(87) PCT Pub. No.: WO2009/143062

PCT Pub. Date: Nov. 26, 2009

(65) Prior Publication Data

US 2011/0068942 A1 Mar. 24, 2011

Related U.S. Application Data

(60) Provisional application No. 61/054,142, filed on May 17, 2008.

(51) Int. Cl.
*G08B 21/00* (2006.01)

(52) U.S. Cl.
USPC ..... 340/636.1; 340/5.91; 340/815.45

(58) Field of Classification Search
USPC ..... 340/636.1, 636.11, 636.19, 641, 643, 340/691.6, 693.2, 5.91, 5.92, 286.09, 340/286.11–286.12, 326, 332, 815.45
See application file for complete search history.

(56) References Cited

U.S. PATENT DOCUMENTS 4,530,067 A * 7/1985 Dorr ..... 705/15
4,701,849 A * 10/1987 Elden ..... 705/7.42
4,777,488 A * 10/1988 Carlman et al. ..... 340/12.5
5,828,294 A * 10/1998 Shank ..... 340/326
6,366,196 B1 * 4/2002 Green et al. ..... 340/286.09
6,636,835 B2 * 10/2003 Ragsdale-Elliott et al. .... 705/15
7,372,361 B1 * 5/2008 Mealing ..... 340/286.09
7,400,228 B2 * 7/2008 Abeyta ..... 340/286.09

FOREIGN PATENT DOCUMENTS

JP 2003108299 A 4/2003
KR 2019950004841 Y1 6/1995
KR 200303300 Y1 2/2003
KR 100596051 B1 7/2006

OTHER PUBLICATIONS

International Search Report of International Patent Application No. PCT/US2009/044354 dated Jan. 7, 2010.

* cited by examiner

*Primary Examiner* — Daniel Previl
(74) *Attorney, Agent, or Firm* — Gary Hoenig

(57) ABSTRACT

A wait staff signaling apparatus and method used to summon wait staff to a restaurant table includes a housing having a plurality of signaling indicators wherein the indicators illuminate by means of a light source driven by a battery and an integral control module when activated by a patron at the table by pressing or touching the respective switch. The indicators are color coded with the color codes corresponding to the type of service required by the patron. The device incorporates a high efficiency secondary optics lens component so as to provide high visibility in all light conditions at a wide variety of viewing angles, including a narrow low angle intense beam for distant viewing, thereby providing a low power, portable, battery driven device with a long service life and a low manufacturing cost.

16 Claims, 5 Drawing Sheets

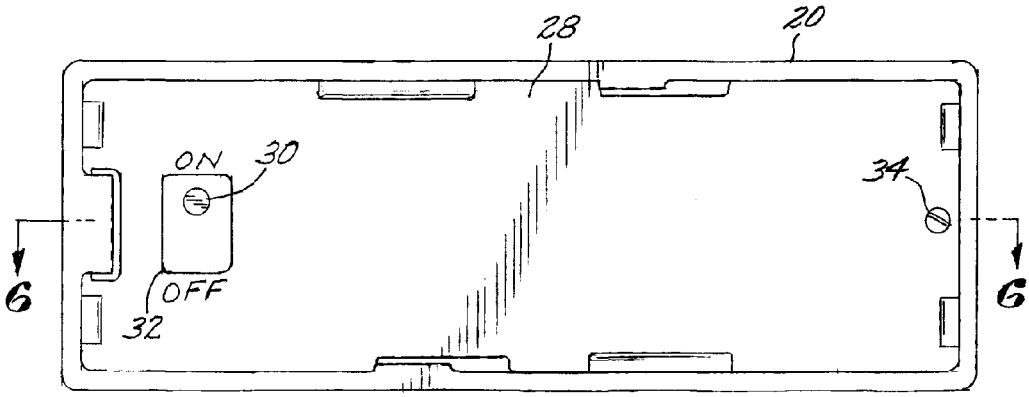
FIG. 3
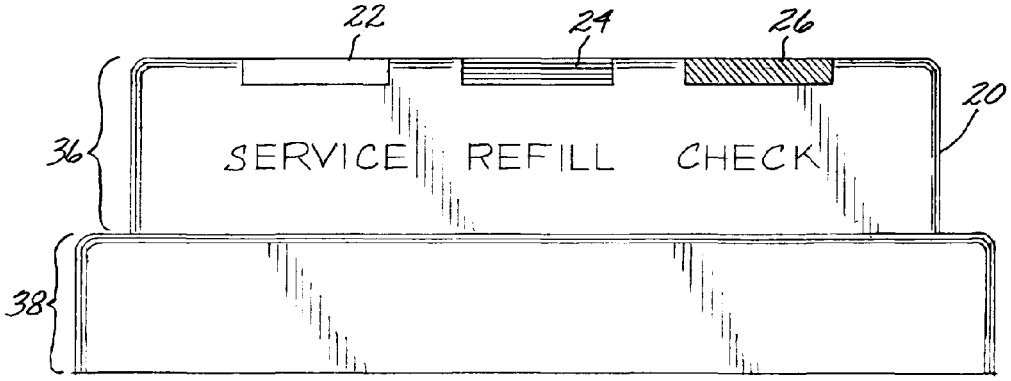
FIG. 4
FIG. 5
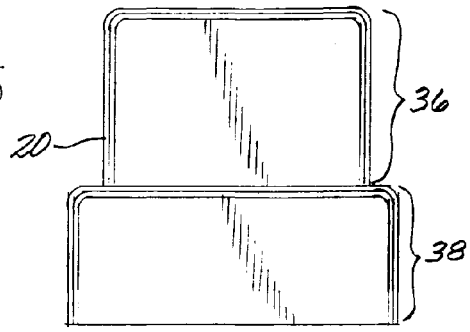

WAIT STAFF SIGNALING APPARATUS WITH HIGH VISIBILITY INDICATORS

BACKGROUND OF THE INVENTION

The present invention relates to an apparatus and method of use thereof for facilitating restaurant wait staff notification of a patron requiring service and of the type of service required. More particularly, this invention is directed to an apparatus and method for visually communicating the service needs of a patron in a restaurant, or similar establishment, by means of high visibility lit indicators.

The prior art is typified by signaling devices that comprise a radio frequency transmitting device placed at the restaurant patron's table with a receiving device located centrally or distributed to pagers to notify wait staff that service is required. Typically transmitting type devices have been preferred due to the wait staff's generally poor visibility of an alert indicator located at the table. Other types of signaling devices are table based visible semaphore or light emitting devices. Of these devices, the prior art table based signaling devices can generally be grouped as those that signal by means of a lit indicator and those that utilize a non-lit flagging element or marker. Non-lit devices are disadvantaged in restaurant environments where the tables are located in low lighting areas as wait staff may have difficulties identifying that a non-lit flagging or marker device has been activated. Depending upon the environment and construction an activated non-lit device does not draw attention as well as a lighted device. Lighted indicator signaling devices located at the table facilitate the wait staff to survey the tables from a distance to determine if service is required; however, the indicator must be clearly visible to the wait staff without having to visually search for the device.

A disadvantage of using light emitting devices is the high level power required to activate the light indicator, particularly for battery power driven devices. Consequently, a short battery life is a limiting factor and disadvantage for such devices. In order to provide high visibility from many view angles, as required in a restaurant environment, the distribution of light must be broad thereby requiring yet more power as compared to a light source directed in a narrow field. Battery driven prior art devices that present an indicator light at the table for purposes of signaling for service typically lack sufficient light distribution to provide a distinctive indicator from most angles thus reducing visibility by the wait staff.

It is important that an indicator be visible to staff by merely glancing toward a table without having to search for a device on the table. A portable device may be placed anywhere on the table and hence the staff does not have a known reference point to check when scanning tables to determine if service is required.

As illustrated, improved communications between the wait staff and the restaurant patron has many beneficiary effects including, but not limited to, an improved overall experience by the patron, increased patron count by decreasing the total meal time, and increased wait staff efficiency. What is needed is an improved battery power driven low cost wait staff signaling apparatus locatable at the patron's table capable of communicating patron requests to the wait staff and providing high visibility so as to noticeable to the wait staff by glancing at the table and without having to visually search for the device on the table.

SUMMARY OF THE INVENTION

Accordingly, the present invention is directed to wait staff signaling devices and methods and, more specifically, to a low power portable wait staff signaling apparatus located at a patron's table utilizing color coded high visibility illuminated indicators controllable by a patron for purposes of signaling to wait staff and communicating the type of service required, thereby substantially obviating one or more of the problems due to the limitations and disadvantages of the related art.

The present invention is a portable apparatus with a plurality of illuminating indicators controlled by the restaurant patron to indicate that service is required; the apparatus having large illuminated indicator surfaces capable of distributing light in a broad range of angles. The patron activates a self-powered illuminating indicator or indicators by means of activator switches which cause corresponding indicators to light. The need for service is signaled by activating the device and the type of service required is communicated by the color coding of the illuminated indicator and/or by the combinations of activated indicators. The apparatus is placed on the table by the wait staff and is activated by the patron. The illuminated indicator is typically deactivated after the service is provided or after attention of the wait staff is accomplished.

A secondary illuminating optic is provided, in each indicator, having substantially a rectangular shape with light collector wing element portions on two sides. The lens provides functionality to maximize the transmission of light from light emitting diodes (LEDs) having a standard T lens thereby increasing the power efficiency of the apparatus. The secondary illuminating optic also distributes the light from the light emitting diodes in a manner to maximize visibility and aesthetics in a table top restaurant application by providing an evenly distributed light glow over the upwardly facing surface of the lens while also providing a high intensity narrow beam from the front and rear exitant sides of the lens and at a low angle to the table top thereby directing a high visibility lighted indication to the wait staff.

It is an object of the invention to provide an improved visual signal device with high visibility from many angles and a method to communicate service requests to wait staff at a distance without the necessity of wires, radio or other communications linking to a separate receiving system. The secondary illuminating optics are fashioned to provide appropriate light intensity at respective viewing angles.

Another objective of the invention is to provide an illuminated indicator permits effective signaling in all light level restaurant environments wherein non-lit indicators are not usable due to darkness or lit indicators are not usable due washout in medium to high light levels. The low angle narrow beams generated by the secondary lens optic facilitate visibility in higher light level applications.

A further objective is facilitate portable use by providing high visibility indicators being battery driven and having an acceptable operational life. The light concentrator appendages of the secondary optics lens minimizes optical coupling losses with the light emitting diodes of the indicators.

BRIEF DESCRIPTION OF THE DRAWINGS

The accompanying drawings, which are incorporated in and constitute a part of this specification illustrate embodiments of the invention and, together with the description, serve to explain the features, advantages, and principles of the invention.

In the drawings:

FIG. 3 is a bottom plan view of the signaling device of FIG. 1.

FIG. 4 is a front side elevation view of the signaling device of FIG. 1.

FIG. 5 is a right side elevation view of the signaling device of FIG. 1.

DETAILED DESCRIPTION OF THE INVENTION

Figure 1:
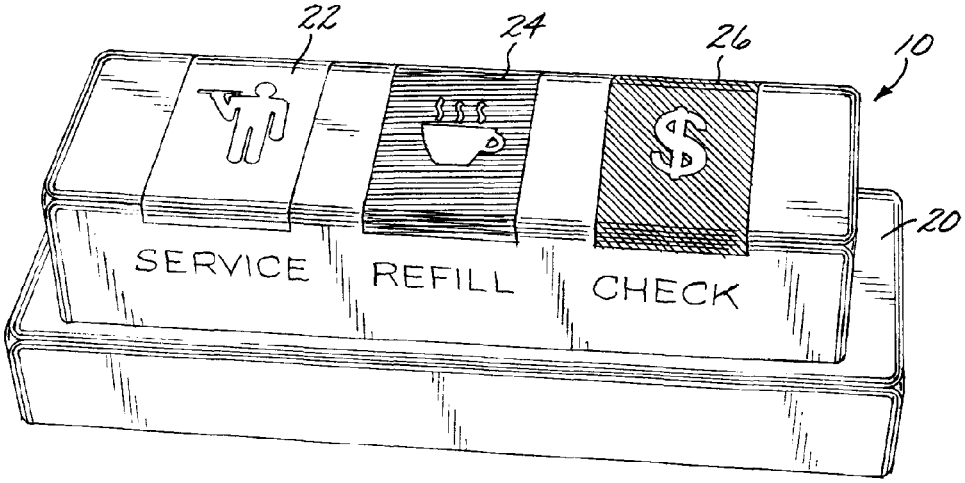
FIG. 1 is a perspective view of the signaling device according to the present invention.

Although particular embodiments of the invention have been described in detail for purposes of illustration, various modifications may be made without departing from the spirit and scope of the invention. Accordingly, the invention is not to be limited except as by the appended claims. Referring now in greater detail to the various figures of the drawing wherein like reference characters refer to like parts, there is shown at 10 in FIG. 1, wait staff signaling apparatus constructed in accordance with the subject invention. Before describing the details of that apparatus it must be pointed out that while the apparatus is particularly suited for affecting wait staff signaling in restaurants, it can also be used for other applications wherein a server is providing service to patrons. Moreover, the subject invention may also be used for non-restaurant applications wherein patrons require a means of signaling service personnel, such as in waiting rooms.

An embodiment of the wait staff signaling apparatus 10 of the present invention as shown in FIG. 1, comprises a housing, a plurality of illuminating indicators mounted outwardly and upward facing in the housing, a battery power supply mounted in the housing, wherein the illuminating indicators are comprised of a light source mounted into a high efficiency secondary illuminating optics lens for capturing and redirecting the source light uniformly outwardly through a non-refracting lens cover providing color, an integral control module in electrical connectivity with the light source, and an activator switch mounted in the housing and in electrical connectivity with the integral control module being in electrical connectivity with the battery power supply. The non-refractive lens surfaces are capacitive touch sensitive by being in proximity to capacitive touch pads, part of the proximity switch, on the integral control module wherein circuitry is provided to detect a touch and operable to activate or deactivate the light source associated with the non-refractive lens cover. Therefore an illuminating indicator is activated or deactivated by the touch or proximity of a user.

Referring further to FIG. 1, the wait staff signaling apparatus, also referred to as the table unit, is shown in perspective wherein first, second and third illuminating indicator assemblies are mounted in housing 20. Each illuminating indicator comprises a non-refractive optical lens cover portion at 22, 24 and 26 molded into the top surface of the housing 20 which is optionally colored; and, a high efficiency transparent lens insert being a secondary illuminating optic secured in a recess, in the bottom of the non-refractive optical lens covers, sized to receive the lens insert disposed directly below each non-refractive optical lens cover.

Figure 2:
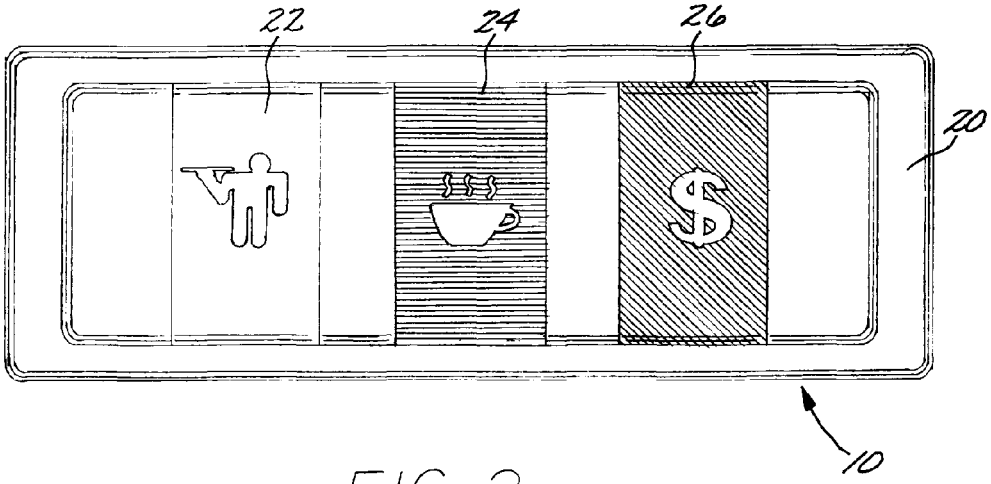
FIG. 2 is a top plan view of the signaling device of FIG. 1.

Each indicators is optionally labeled with text or a symbol representing the type of service requested with the indicator is activated. Example symbols are shown in the top plan view of FIG. 2 wherein lens 22 has a waiter, being a symbol for general service, lens 24 has a coffee cup, being a symbol for beverage refill, and lens 26 has a dollar sign for requesting the check.

Referring to FIG. 3, the apparatus being battery operated has a power switch 30 located in a recess 32 in the bottom housing plate 28 which is removable by releasing securing fastener 34 so as to gain access to a battery compartment for replacement purposes. The power switch 30 is provided to deactivate the device thereby eliminating any power drain of the internal batteries when not in use.

As illustrated in FIG. 4, being a front elevation view of the apparatus, the generally rectangular shape of the housing 20 is visible. The housing has a top portion 36 and a bottom portion 38 wherein the bottom portion has expanded dimensions and has an inner recess sized to fit over the outside of the top portion 36 of the housing 20 such that the devices may be stacked upon each other for storage.

The right side elevation view in FIG. 5, further illustrates the rectangular shape of the housing 20 with the lower portion 38 sized to fit over the top portion 36 of another identical device.

Figure 6:
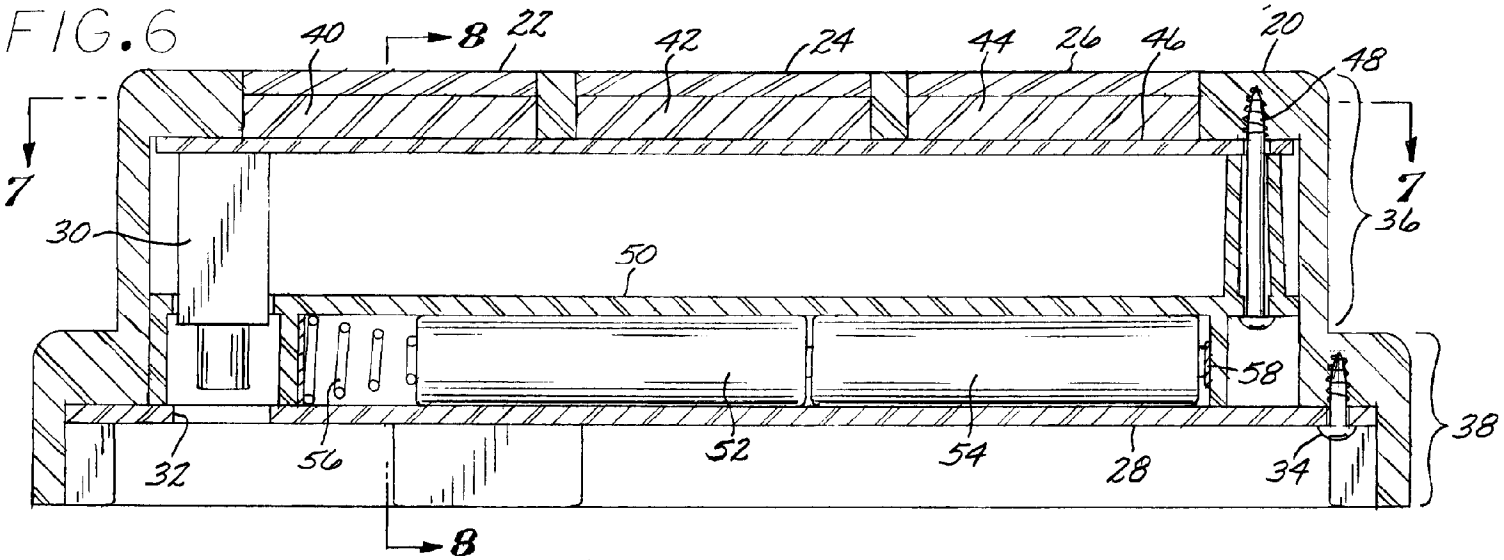
FIG. 6 is a cross section view taken along Line 6-6 of FIG. 3 showing the internal elements and their spatial relationship to each other according to the present invention.

Details of the spatial arrangement of the elements of the device are illustrated in FIG. 6 where the first, second and third high efficiency secondary illuminating optic lens inserts 40, 42 and 44 are positioned below and in contact with the corresponding colored white, blue and green translucent lens covers 22, 24 and 26. The integral control module 46 is positioned below the lens inserts and provides the electrical control for the apparatus. The control module 46 is in electrical connectivity with a battery power supply, illustrated, in part, at 52 and 54. The control module 46 comprises a printed circuit board having capacitive touch pad traces etched in positions directly adjacent and below the lens inserts 40, 42, and 44. The control module 46 further has electronic circuitry for detecting the presence of a user in proximity of the touch pad by means of capacitive touch detection circuitry. A microprocessor, also incorporated in the control module, is programmed to activate or deactivate light emitting diode (LED) lamps responsive to a touch being detected. The microprocessor is further programmed to provide power management so as to maximize battery life wherein the device enters a low power mode when no touch activity is detected. Further the microprocessor may flash the lamps to indicate a low battery condition, provide a variable flash rate dependent upon the time the lamps have been active, or shut the lamps off after a period of time to save power. Still further, the microprocessor is programmed to allow only one indicator to be illuminated at any given time.

Again in FIG. 6, the control module 46 further comprises a power switch 30 protruding downwardly through inner housing 50. The inner housing 50 also forms a battery holder with electrical battery contacts 56 and 58 providing electrical communication to the integral control module. The power switch 30 is accessible through power switch recess opening 32 to allow a user to disable the device when not in use. Note that the inner housing 50 is secured to housing 20 by means of inner housing fastener 48 thereby allowing a user to remove the bottom plate 28 by removing bottom fastener 34 to gain access to the batteries without gaining access to the integral control module 46.

Figure 7:
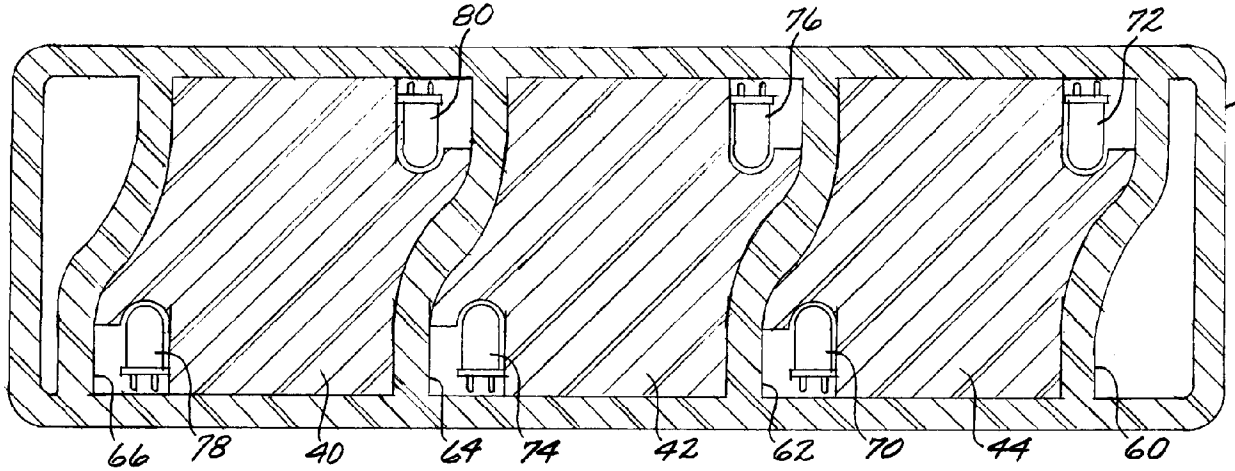
FIG. 7 is a cross section view taken along Line 7-7 of FIG. 6 illustrating details of the high efficiency lens inserts with the illuminating LEDs in position.

Referring now to FIG. 7, being a cross section view taken on Line 7-7 of FIG. 6, the top of the first, second, and third lens inserts 40, 42, and 44 are shown separated by light baffles 60, 62, 64, and 66 thereby preventing light from leaking over from one illuminator assembly to the next. The lens inserts are secondary illuminating optics designed to maximize the light capture from two LEDs each at 70 and 72, 74 and 76, and 78 and 80 respectively. The secondary illuminating optic is designed to capture and redirect the light from the LEDs across the top surface of the lens insert upwardly and out opposing vertical exitant side surfaces so as to direct light out the front and back sides of the apparatus. The projection of light out the side provides a narrow rectangular distribution of light at a low angle relative to a table top surface and having a higher intensity than out the top surface. This low angle higher intensity beam is designed to provide further distance for visibility to wait staff, that typically would be viewing at a lower angle as they are distant from a table, while providing a lower intensity upward illumination towards guests seated at the table.

Figure 8:
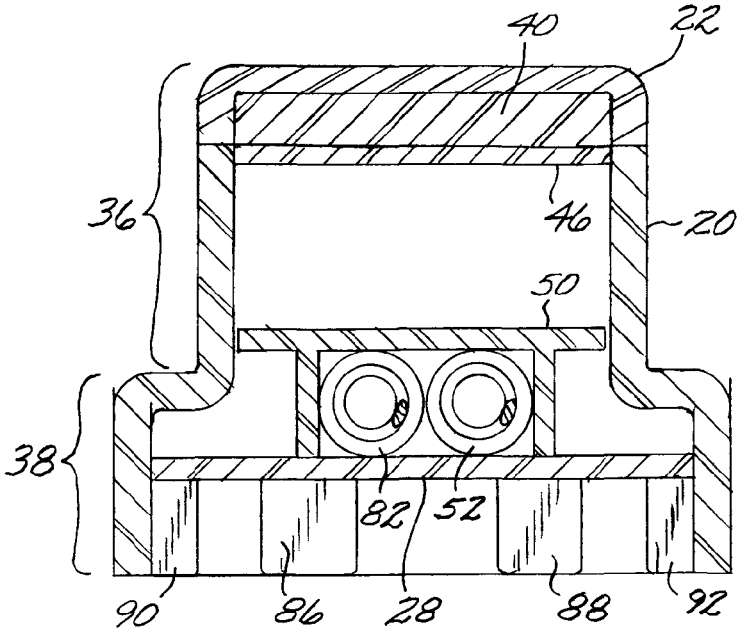
FIG. 8 is a cross section view taken along Line 8-8 of FIG. 6 showing details of the housing lens cover surrounding the projecting surfaces of the high efficiency lens insert according to the present invention.

FIG. 8 illustrates the recessed fit of the lens insert 40 within the non-refractive lens cover 22. Note that the outwardly faces side edges of the lens insert 40 are also flush with and behind the cover 22 so as to provide an exit path for the exitant light beam out the side of the apparatus. Note also the spacing between the inner housing 50 and the integral control module 46, therein provided to distance the batteries 52 and 82 from the integral control module as a closer proximity of the batteries to the integral control module is disruptive to the capacitive touch detection mechanism.

Further in FIG. 8, the bosses 86, 88, 90, and 92 are representative of bosses, extending from the bottom of the housing bottom plate 28, positioned periodically around the exterior of the recess of the bottom portion 38 of the housing 20 so as to provide a snug fit over the top portion 36 of the housing 20 of another device. The stacking facility is illustrated in FIG. 9 wherein the top of the housing of another device 84 is positioned within the recess of the bottom plate and cradled by bosses 90 and 86.

Figure 9:
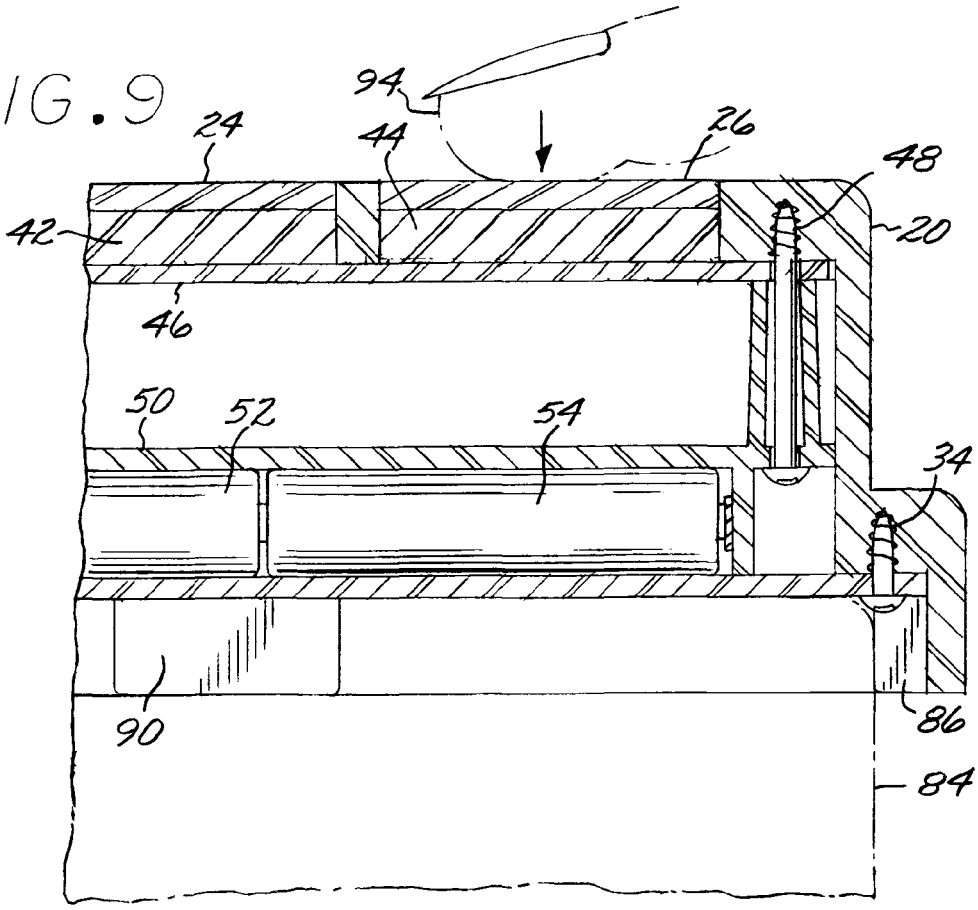
FIG. 9 is a portion of the cross section view of FIG. 6 illustrating the touch activation of the green indicator of the present invention.

Also note in FIG. 9 that the user's figure, when touching or in close proximity to the lens cover 26 provides an increase in electrical capacitance which is detected by the integrated control panel which in turn directs the LED lamps associated with the lens cover to be activated or deactivated.

Figure 10:
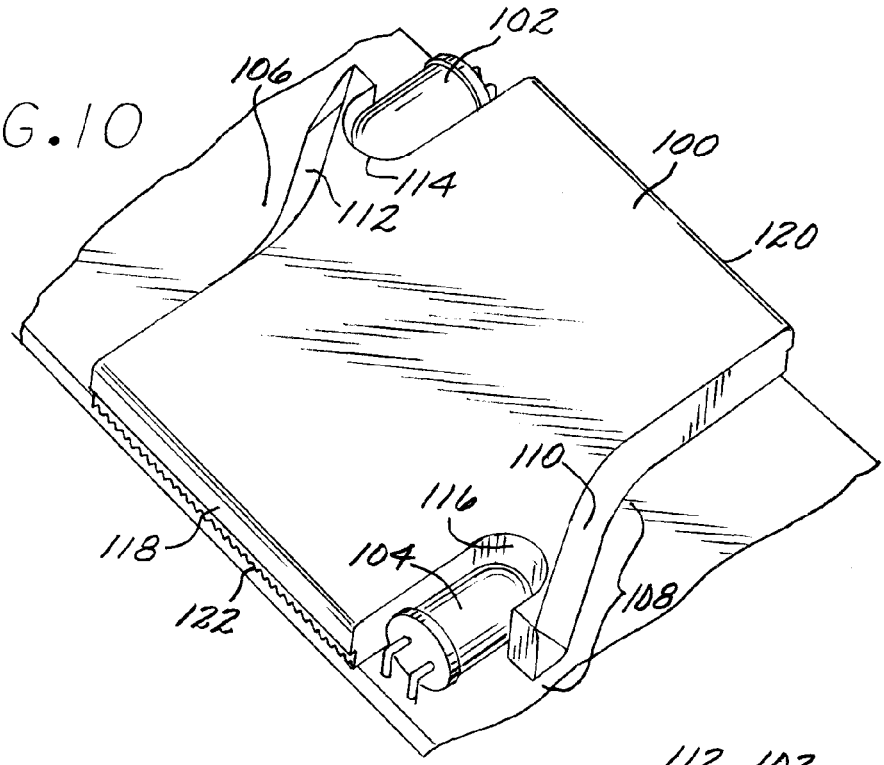
FIG. 10 is a perspective view of one of the high efficiency lens inserts in position on the printed circuit of the control module with the diffusion portion against the control module touch pad area and the illuminating LEDs in position.

Of particular importance in this embodiment of the present invention is the secondary illuminating optic lens insert. The design is critical to operation of the apparatus. An embodiment of the lens is shown at 100 in FIG. 10. An LED lamp with a T type design generally emits light in a conical projection from the top of the LED at typically 20 to 30 degrees. In order to provide high efficiency, a secondary illuminating optic lens is provided to maximize the capture of the emitted light and redirect the light for useful purposes. As shown in FIG. 100, the secondary illuminating optic lens comprises a flat rectangular optic having a top surface and bottom surface, a front 118 and rear 120 vertical exitant surface, a first and second wing shaped portions 106 and 108, each comprising an incident refractive surface 114 and 116 and an optically active reflective surface 112 and 110, forming the sides of the lens. The lens thickness is the same or greater than the width of the LED T lens utilized and may be constructed of any suitable optical material. The incident refractive surfaces 116 and 114 are designed in an arch shaped curvature to match the cross sectional profile of the LED for providing efficient light and optical coupling between the LED and the lens. The second optically active surface being a reflective surface, within the wing portion, is shown at 110 and 112, along the outer surface of the wing portion, wherein the surface is contoured outwardly relative to the top of the lens so as to reflect light inwardly and downwardly into the interior of the lens. Further, these surfaces are contoured to distribute and direct light across the interior of the lens so as to provide even illumination of the bottom surface of the lens and positioned to allow even distribution of light out the vertical exitant side surfaces 118 and 120. Two wings are provided, positioned on opposite sides and opposing, such that each wing illuminates the respective half of the lens towards which the LED is directed. Light is directly channeled to the vertical exitant side surface in the direction of the illuminating LED. The bottom of the lens 100 further comprises a grating 122 designed to reflect and diffuse light from the wing portions 106 and 108 upwardly and uniformly to the top surface of the lens thereby providing even upward illumination across the entire top surface of illuminating optic lens.

Figure 11:
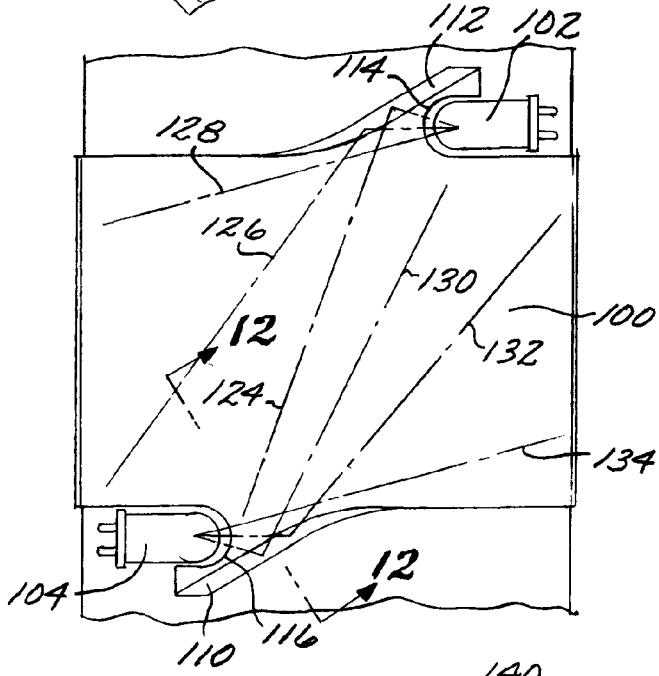
FIG. 11 is a top plan view of high efficiency lens insert showing the contoured reflecting surfaces of the lens wing portions collecting and reflecting light rays into the interior of the high efficiency lens insert.

Example light ray pathways are illustrated in FIG. 11, at top plan view of the secondary illuminating lens 100. Light emitted by LED 104 is captured by the incident surface 116 of the first wing portion and reflected by the reflective surface 110 into the interior and bottom of the lens at 130 and 132 while the opposing vertical exitant surface is directly illuminated, without reflection, from the LED at 134. Similarly, light emitted by LED 102, facing the opposing direction, is captured by the incident surface 114 of the second wing portion and reflected by reflective surface 112 into the interior and bottom of the lens at 124 and 126 while the opposing vertical exitant side surface is directly illuminated, without reflection, at 128.

Note that the reflective surfaces of the wing portions may also be contoured to illuminate the same interior and bottom portions of the lens as the exitant side surface.

Figure 12:
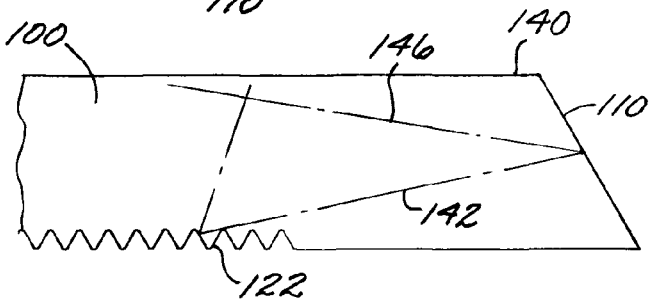
FIG. 12 is a cross section view of the high efficiency lens insert of FIG. 11 taken along Line 12-12 additionally showing the effect of the bottom diffusion surface of the lens insert.

Referring lastly to FIG. 12, the optical effect of the grated surface 122 of the lens 100 is illustrated wherein the example ray pathways 142, initially reflected by wing surface 110, is reflected to and out the top surface 140 of the lens by the grating 122. Many pathways are available and, like pathway 146, light may be reflected to the top surface directly. The net resulting illumination is even and uniform across the top surface thereby providing a uniform glow appearance to the entire lens cover when the LEDs are activated.

The apparatus is powered on by pressing the power switch. After placement on a table, a user brings one's finger within close proximity of the lens cover illustrating the type of service required. The integral control module detects the increased capacitance induced by the user's finger near the lens cover and, performing as a proximity switch, activates the LED lamps within the associated indicator assembly. The secondary illuminating optic lens of the assembly directs the LED light and provides a uniform upwardly directed light through the lens cover. A high intensity narrow beam of light is also projected from the front and rear of the device to provide high visibility to wait staff at a distance and a low viewing angle to the table top. The indicator is deactivated by means of placing one's finger in close proximity to the indicator a second time.

What is claimed is:

1. A wait staff signaling apparatus having high visibility indicators comprising;

a housing having a front, rear, top and bottom, a plurality of light sources, each light source comprising a first and a second LED, a control module mounted in the housing operable to activate, deactivate, and manage the power consumption of the plurality of light sources, and incorporating a plurality of touch proximity switches operable to energize respective light sources when activated by a user, a plurality of illuminating indicators each mounted to be outwardly facing in the top and front and rear of the housing and adjacent to a control module proximity switch, wherein the illuminating indicators comprise a comprises one of the light sources, a lens cover, and a secondary illuminating optic lens having a top surface and bottom surface, a front and rear vertical exitant surface, the secondary illuminating optic being positioned within the translucent lens cover disposed with the to surface facing upwardly and the front and rear vertical exitant surfaces facing to the front and rear in the housing respectively, and arranged in combination to direct the light emitted from the light source to evenly illuminate the lens cover and also direct a narrow rectangular beam from the front and rear of the housing; each indicator having the light source in electrical connectivity with the control module; and, a battery power supply mounted in the housing and in electrical connectivity with each illuminating indicator light source and the control module.

2. The wait staff signaling apparatus of claim 1 wherein the secondary illuminating optic further comprises a first and second wing shaped portion, each comprising an incident refractive surface shaped to optically couple with the respective first and second LEDs, and a reflective surface, the wing portions forming two sides of the secondary illuminating optic.

3. The wait staff signaling apparatus of claim 2 wherein the incident refractive surface of the wing shaped portion is shaped to optically couple with an LED lens.

4. The wait staff signaling apparatus of claim 2 wherein the optically active reflective surface of the wing shaped portion is contoured to reflect, direct and distribute light across the bottom of the secondary illuminating optic.

5. The wait staff signaling apparatus of claim 2 wherein the wing portions are arranged opposing each other and are positioned along the side of the secondary illuminating optic operable to direct a portion of light from the light source towards a vertical exitant surface of the secondary illuminating optic and to produce a low angle narrow beam of high intensity light from the front and rear of the housing.

6. The wait staff signaling apparatus of claim 2 wherein the secondary illuminating optic receives an LED T style light source.

7. The wait staff signaling apparatus of claim 1 wherein the secondary illuminating optic is further comprising a diffusion grating on the bottom surface.

8. The wait staff signaling apparatus of claim 1 wherein there are three illuminating indicators with lens covers colored white, blue and green respectively.

9. The wait staff signaling apparatus of claim 1 wherein the light source is a light emitting diode.

10. The wait staff signaling apparatus of claim 1 wherein the control module is operable to flash an illuminating indicator when the battery power supply is in a low battery condition.

11. The wait staff signaling apparatus of claim 1 wherein the housing has a top and bottom portion, the bottom portion having expanded dimensions to receive the top portion of another wait staff signaling apparatus within the bottom portion dimensioned to permit stacking of the devices.

12. The wait staff signaling apparatus of claim 1 wherein the proximity switches of the control modules are mounted below and adjacent to the illuminating indicator whereby a user may activate a corresponding indicator by being in proximity to the lens cover of the indicator.

13. The wait staff signaling apparatus of claim 1 wherein the control module further comprises a power switch for selectively deactivating the apparatus so as to conserve the battery power supply.

14. The wait staff signaling apparatus of claim 1 wherein the lens covers are non-refractive.

15. The wait staff signaling apparatus of claim 1 wherein the control module is further operable to provide a variable flash rate of the light source dependent upon the time the lamps have been active.

16. The wait staff signaling apparatus of claim 1 wherein the control module is further operable to allow only one indicator to be illuminated at any given time.

* * * * *